US005248896A

United States Patent [19]

Forrest

[11] Patent Number: 5,248,896

[45] Date of Patent: Sep. 28, 1993

[54] POWER GENERATION FROM A MULTI-LOBED DRILLING MOTOR

[75] Inventor: John Forrest, Houston, Tex.

[73] Assignee: Drilex Systems, Inc., Houston, Tex.

[21] Appl. No.: 973,602

[22] Filed: Nov. 9, 1992

Related U.S. Application Data

[63] Continuation of Ser. No. 755,258, Sep. 5, 1991, abandoned.

[51] Int. Cl.[5] ..... F03B 13/02; E21B 4/02

[52] U.S. Cl. ..... 290/1 R; 290/43; 290/54; 175/94; 175/99; 175/107

[58] Field of Search ..... 175/94, 99, 107; 310/75 R; 290/43, 54; 475/176

[56] References Cited

U.S. PATENT DOCUMENTS

| | | | |
|---|---|---|---|
| 2,874,594 | 2/1959 | Sundt | 475/176 |
| 2,978,634 | 4/1961 | Arps | 310/75 R |
| 3,036,645 | 5/1962 | Rowley | 175/93 |
| 3,840,080 | 10/1974 | Berryman | 175/107 |
| 3,964,558 | 6/1976 | Fogle | 175/107 |
| 4,134,024 | 1/1979 | Wiseman | 290/52 |
| 4,369,373 | 1/1983 | Wiseman | 290/54 |
| 4,491,738 | 1/1985 | Kamp | 290/43 |
| 4,577,116 | 3/1986 | Pinson | 290/43 |
| 4,654,537 | 3/1987 | Gaspard | 290/54 |
| 4,732,225 | 3/1988 | Jurgens et al. | 290/43 |
| 4,740,711 | 4/1988 | Sato et al. | 290/52 |
| 4,816,697 | 3/1989 | Nalbandyan et al. | 290/54 |

*Primary Examiner*—A. D. Pellinen
*Assistant Examiner*—Robert Lloyd Hoover
*Attorney, Agent, or Firm*—Edgar A. Zarins; Malcolm L. Sutherland

[57] ABSTRACT

A power generation unit associated with a downhole drilling motor capable of producing sufficient rotational speeds to produce power for operating downhole devices associated with the drilling operation. The power generation unit takes advantage of the high speed precessional rotation of the rotor within the stator to drive the generator. The assembly includes a multi-lobed rotor displaceable within a stator using drilling fluid pumped therethrough. A crankshaft, mounted at one end concentric with the rotor and at its high speed take-off end concentric with the stator, transfers the rotor center precession to the shaft of the generator. In a preferred embodiment, the generator will include a socket for simply connecting downhole devices requiring electrical power.

19 Claims, 2 Drawing Sheets

POWER GENERATION FROM A MULTI-LOBED DRILLING MOTOR

This is a continuation of application Ser. No. 07/755,258 filed on Sep. 5, 1991, now abandoned.

BACKGROUND OF THE INVENTION

I. Field of the Invention

This invention relates to the generation of electrical power within a downhole drilling motor and, in particular, to power generation utilizing the high speed center precession motion of the rotor in a positive displacement multi-lobed drilling motor.

II. Description of the Prior Art

The multi-lobed drilling motor includes a rotor which is positively displaced within a stator by pumping drilling fluid through the motor thereby driving the downhole drill bit. The rotor moves within the stator in two distinctly different motions, namely "rotation" of the rotor within the stator and "precession" of the rotor center in relation to the axial center of the stator. Still other drilling motors use turbines rotated by drilling fluids pumped downhole to drive the downhole drill bit. In the turbine drilling motors the turbine rotor is aligned with the axis of the housing and rotates about this axis.

Prior attempts have been made to convert the rotational motion of the rotor of these drilling motors into electrical power through a conventional generator associated with the drilling motor. Although electrical power can be generated, the normal motor operating speed is too low to drive an electrical generator capable of powering sophisticated instrumentation. In these prior known drilling motors, the rotor shaft of the drilling motor power section is connected to some type of transmission coupling which in turn is connected to the main shaft of the generator. In at least one known power generation unit the transmission coupling is a non-contact magnetic coupling. Still others utilize direct connection through a solid shaft or universal joints in order to transmit the rotation of the rotor shaft to the shaft of the generator Nevertheless, each of the prior known downhole power generation units suffers from the same fatal flaw of not being capable of generating sufficient rotational speed to drive a generator capable of producing sufficient power levels.

SUMMARY OF THE PRESENT INVENTION

The present invention overcomes the disadvantages of the prior known power generation devices by harnessing the precessional motion of the rotor in a positive displacement drilling motor to drive a generator associated with the downhole motor.

The present invention is dependent upon a multi-lobed positive displacement drilling motor of a well-known type which includes a multi-lobed helical rotor rotatably received within a helical stator. In the typical multi-lobed drilling motor, the rotor incorporates one less lobe than the stator such that the rotor may be positively displaced within the stator by pumping drilling fluid through this power section. The displacement of the rotor in turn drives the drill bit at the downhole end of the tool. Connected to the upper end of the rotor is a crank which, in turn, is connected to a high speed power take off. The upper end of the crank and the high speed take off are mounted concentric with the stator in order to take advantage of the precessional rotation of the rotor axis. The high speed take off is connected directly to the power generator to drive the generator shaft. A typical electrical generator is contemplated for use with this invention. In a preferred embodiment, the upper end of the unit may include an electrical socket to facilitate coupling to associated devices and instrumentation requiring electrical power.

Thus, the present invention utilizes the high speed rotation of the center of the rotor to drive an electrical generator which can be used to power instruments, servos or other requirements for electrical power during the time the motor is running. Alternatively, the generator can be used to charge a battery associated with the unit.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
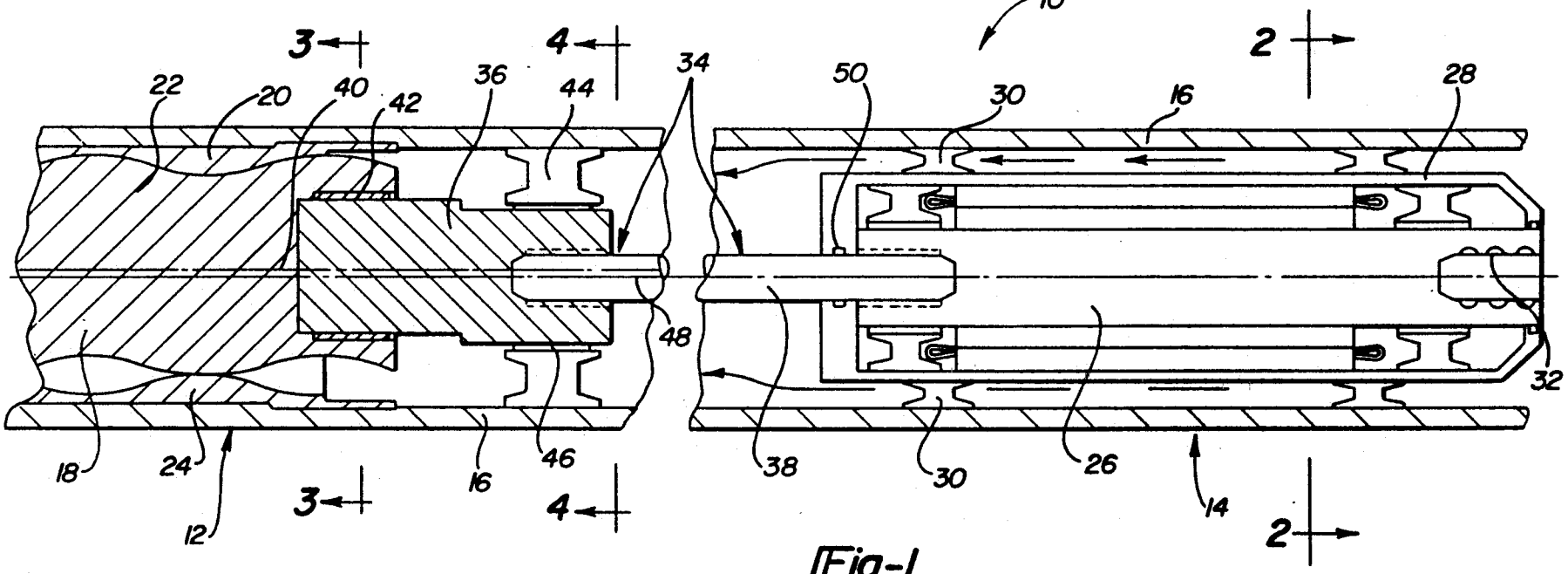
FIG. 1 is a partial cross-sectional perspective of a power generation unit associated with a multi-lobed downhole drilling motor embodying the present invention.

Referring to the drawings, there is shown a power generation unit 10 embodying the present invention which translates the precessional motion of a drilling motor 12 into electrical power through an electrical generator 14. The power generation unit 10 is housed within an outer casing 16 which facilitates running into a borehole and directs drilling mud from the surface to the downhole tools. The power generated by this invention may be utilized to operate downhole instrumentation, servos, data processors or similar devices which could make the drilling motor 12 an independently operable unit within the borehole.

Figure 3:
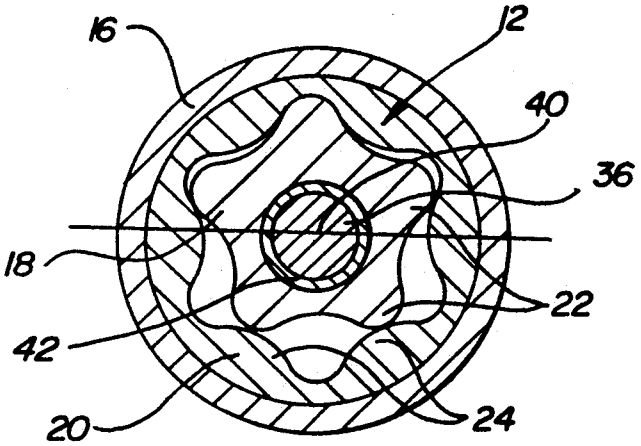
FIG. 3 is a lateral cross-section taken along lines 3—3 of FIG. 1.
Figure 4:
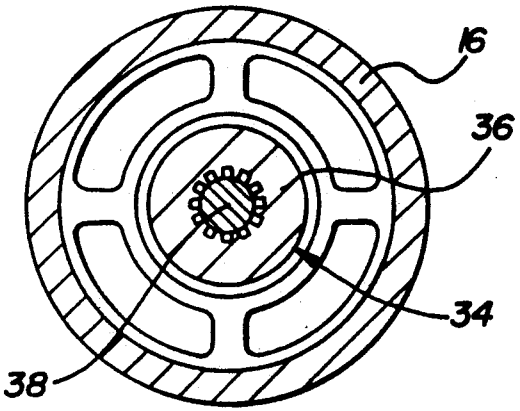
FIG. 4 is a lateral cross-section taken along lines 4—4 of FIG. 1.
Figure 2:
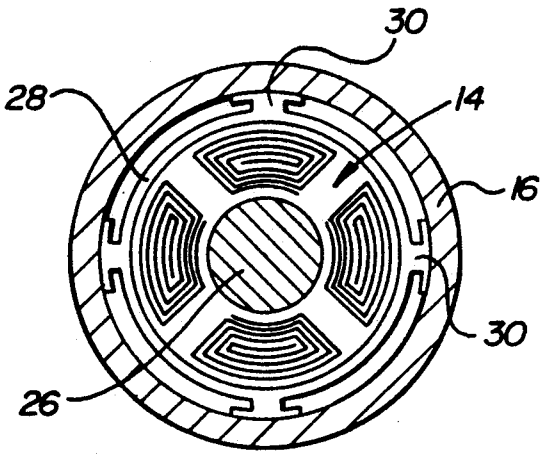
FIG. 2 is a lateral cross-section taken along lines 2—2 of FIG. 1.

The drilling motor 12 is preferably a multi-lobed positive displacement drilling motor comprising a helical rotor 18 received within a helical stator 20. As is best shown in FIG. 3, the rotor 18 incorporates one less helical lobe than the stator 20 which is fixedly mounted within the casing 16. In a first preferred embodiment, the rotor 18 includes five helical lobes 22 while the stator 20 has six helical lobes 24 whereby the rotor 18 may be positively displaced within the stator 20 by pumping drilling fluid through the motor 12 in a well known manner. Typically, the rotor 18 is connected to a downhole bit box (not shown) such that combined rotational displacement of the rotor 18 within the stator 20 will operate the drill bit for rotary drilling. Alternative embodiments of the drilling motor 12 (FIG. 5) may include a greater number of helical lobes on the rotor 18 and stator 20 to vary the operating parameters of the drilling motor 12 as well as the power generation unit 10 of the present invention as will be subsequently described.

The generator 14, illustrated in schematic form, may be of any well known type which depends upon the rotational velocity of a generator core 26 to generate electrical power. In a preferred embodiment of the invention, the generator 14 is encased within a housing 28 to prevent drilling fluids from fouling the generator 14. The housing 28 is radially supported by a plurality of support members 30 which engage the generator 14 and casing 16 such that drilling fluid may flow through the path therebetween to the drilling motor 12 and below. The generator 14 includes means for connecting auxiliary devices to its power source, preferably a socket 32 allowing for modular connection of auxiliary devices.

In order to transmit the precessional motion of the rotor 18 of the drilling motor 12 to the generator 14, a transmission shaft 34 is connected therebetween. The transmission shaft 34 preferably comprises two components: a crankshaft 36 and a power take-off shaft 38. The crankshaft 36 includes two offset portions one of which is connected directly to the rotor 18 in axial alignment with the center 40 of the rotor 18. The offset end of the crankshaft 36 is supported within the rotor 18 by radial bearings 42 allowing the end of the shaft 36 to rotate within the end of the rotor 18 as the rotor 18 precesses within the stator 20. Thus, the offset end of the crankshaft 36 will travel along the precessional trail of the rotor center 40 as will be subsequently described, i.e. the end of the crankshaft 36 rotates relative to the center line of the rotor 18. The other end of the crankshaft 36 is radially supported by support members 44 and radial bearings 46 in axial alignment with the center 48 of the stator 20 and the generator 14. The supported end of the crankshaft 36 will rotate within the supports 44 in response to the offset motion of the rotor 18.

The power take-off shaft 38 is connected directly to the crankshaft 36 and the generator 14. A first end of the power take-off shaft 38 is drivingly connected to the core 26 of the generator 14 such that rotation of the take-off shaft 38 will translate to the core 26. Preferably, a seal 50 is utilized around the shaft 38 to prevent drilling fluid from entering the generator 14. A second end of the power take-off shaft 38 is linearly connected to the axial portion of the crankshaft 36 concentric with the center 48 of the unit 10. As a result, the rotation of the supported portion of the crankshaft 36 will be transmitted to the power take-off shaft 38 and, in turn, to the generator 14.

Figure 5:
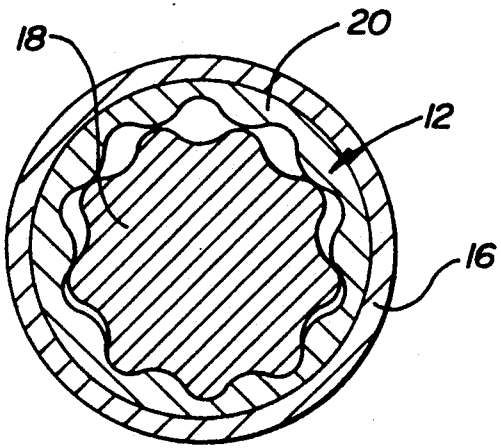
FIG. 5 is a lateral cross-section of an alternative embodiment of the power section of the drilling motor.

Operation of the power generation unit 10 of the present invention will generate sufficient power to operate any conceivable downhole devices associated with the drilling operation including instruments, data processors, servos or other requirements for electrical power during the time the drilling motor is running. Alternatively, in order to provide a continuous supply of power, the unit may be utilized to charge a battery which powers the instruments. In the multi-lobed drilling motor 12 the rotor 18 moves within the stator 20 in two distinctly different modes, i.e. "rotation" and "precession". The instantaneous center 40 of the rotor 18 is offset from the center 48 of the stator 20 by a known distance depending upon the interrelational structure of the power section, namely the number of lobes in the motor 12. As the outer surface of the rotor 18 rolls over the inner surface of the stator 20, the center 40 of the rotor 18 follows a circular path as generally shown in FIGS. 3 and 5. As previously discussed, the number of lobes 24 on the stator 20 is one greater than the rotor 18 leading to a relative angular displacement of approximately one lobe pitch for every rotation of the rotor center 40. This produces a gear pair, the speed ratio of which can be defined as follows:

$$R_{OUTPUT} = \frac{R_{PRECESSION}}{T_{ROTOR}}$$

whereby:

$R_{OUTPUT}$ = Motor output rotational speed $R_{PRECESSION}$ = Motor angular precessional speed $T_{ROTOR}$ = Number of rotor lobes or teeth The normal output of the motor 12 is taken at the speed determined by the angular displacement of the rotor 18 relative to the stator 20. However, it has been determined that the normal motor operating speed is too low to drive an electrical generator of levels sufficient to create the necessary power. The present invention utilizes the high-speed precessional motion of the rotor center to drive the generator 14. A typical downhole drilling motor runs in the range of 60–300 rpm. Because of the restricted rotor diameter of the tool and these low rotational speeds it is very difficult to generate the necessary power unless a mechanical gear unit is incorporated. By harnessing the precessional motion of the rotor 18, the crankshaft rpm is increased considerably as illustrated in the following table.

| MOTOR OUTPUT MAXIMUM RPM | ROTOR/STATOR LOBES | MAXIMUM CRANK RPM |
|---|---|---|
| 337 | 5/6 | 1685 |
| 177 | 7/8 | 1239 |
| 186 | 9/10 | 1674 |

Thus, the present invention takes advantage of the precessional movement of the rotor 18 within the stator 20 to transmit the rotational speeds to the take-off shaft 38 and the generator 14. The precessional movement of the rotor 18 provides an opposite rotational direction for the transmission shaft 34 than experienced by the rotor. As the rotor 18 rotates about its own center in a clockwise direction displaced by drilling fluid pumped through the stator thereby driving a downhole drill bit, the crankshaft 36 will roll counter-clockwise within the rotor 18 resulting in a counter-clockwise revolution of the transmission shaft 34 about the center axis of the stator 20. This resultant precessional movement of the rotor about the rotor axis is harnessed and transmitted through the transmission shaft to the generator 14. Each roll of a lobe of the rotor 18 into a specific cavity about the stator surface results in one precessional revolution of the rotor axis about the stator axis. As a result, for each complete rotation of the rotor 18 within the stator 20, the transmission shaft will revolve about the axis of the stator 20 a multiple corresponding to the number of lobes on the rotor. The revolving movement of the transmission shaft about the stator axis will therefore be substantially greater than the rotational velocity of the rotor about its own axis, that is, the transmission rotational velocity would equal the rotational velocity of the rotor times the number of rotor lobes.

The foregoing detailed description has been given for clearness of understanding only and no unnecessary limitations should be understood therefrom as some modifications will be obvious to those skilled in the art without departing from the scope and spirit of the appended claims.

What is claimed is:

1. A power generation unit for a downhole drilling assembly comprising:

a drilling motor including a stator and rotor wherein drilling fluid flows through said motor to drive said rotor within said stator;

generator means mounted within said unit; and a transmission shaft for transmitting precessional revolution of said rotor relative to said stator to said generator means for generating electrical power as said rotor rotates within said stator such that the high speed precessional revolution of the rotor center is in a first direction about an axis of the stator as the transmission shaft rotates within the stator in a second direction.

2. The unit as defined in claim 1 wherein said drilling motor is a multi-lobed positive displacement drilling motor including a helical rotor displaceably driven within a helical stator mounted within a casing of said unit, said rotor rotatably displaced within said stator as drilling fluid is pumped through said drilling motor to operate a downhole drill bit.

3. The unit as defined in claim 2 wherein said rotor has one less helical lobe than said stator to facilitate displacement of said rotor within said stator.

4. The unit as defined in claim 3 wherein said rotor includes five helical lobes and said stator includes six helical lobes.

5. The unit as defined in claim 3 wherein said rotor includes nine helical lobes and said stator includes ten helical lobes.

6. The unit as defined in claim 3 wherein said rotor/stator lobe ratio is within the range of $\frac{2}{3}$ to 12/13.

7. The unit as defined in claim 2 wherein said transmission shaft includes a crankshaft and a power take-off shaft linearly connected to said crankshaft, a first end of said power take-off shaft drivingly connected to said generator means.

8. The unit as defined in claim 7 wherein said crankshaft includes a first end connected to said power take-off shaft and axially aligned with said power take-off shaft and a central axis of said stator of said drilling motor, said crankshaft including an offset second end connected to said rotor of said drilling motor, said offset second end of said crankshaft axially aligned with a central axis of said rotor whereby said second end of said crankshaft travels along the center precessional motion of said rotor transmitting high speed rotation to drive said generator means.

9. The unit as defined in claim 8 wherein said first end of said crankshaft is supported by radial bearing supports connected to said casing.

10. The unit as defined in claim 8 wherein said generator means comprises an electrical generator mounted within said casing by radial supports such that drilling fluid may flow downhole past said generator to said drilling motor.

11. The unit as defined in claim 10 wherein said electrical generator includes connector means for connecting an auxiliary device to the electrical output of said generator.

12. A power generation unit for a downhole drilling assembly including a casing and having drilling fluid selectively pumped therethrough, said power generation unit comprising:

a multi-lobed positive displacement drilling motor including a helical stator and rotor each having a plurality of helical lobes wherein drilling fluid flows through said motor to displaceably rotate said rotor within said stator to selectively drive a downhole drilling device;

an electrical generator mounted within the casing of said unit for generating electrical power to auxiliary devices associated with the downhole drilling assembly; and a transmission shaft for transmitting precessional revolution of said rotor relative to said stator as the drilling fluid is pumped through said drilling motor to said electrical generator thereby generating electrical power to auxiliary devices such that the high speed precessional revolution of the rotor center is in a first direction about an axis of the stator as the transmission shaft rotates within the stator in a second direction.

13. The unit as defined in claim 12 wherein said rotor has one less helical lobe than said stator to facilitate displacement of said rotor within said stator, said rotor rotatably displaced within said stator creating said precessional motion of a central axis of said rotor.

14. The unit as defined in claim 13 wherein said transmission shaft includes a crankshaft and a power take-off shaft linearly connected to said crankshaft, a first end of said power take-off shaft drivingly connected to said electrical generator.

15. The unit as defined in claim 14 wherein said crankshaft includes a first end connected to said power take-off shaft and axially aligned with said power take-off shaft and a central axis of said casing, said crankshaft including an offset second end connected to said rotor of said drilling motor, said second end of said crankshaft axially aligned with said central axis of said rotor whereby said second end of said crankshaft travels along the center precessional motion of said rotor transmitting high speed rotation to drive said electrical generator.

16. The unit as defined in claim 15 wherein said electrical generator includes connector means for connecting an auxiliary device to the electrical output of said generator.

17. In a downhole drilling device having a casing and a multi-lobed positive displacement drilling motor housed within the casing, the motor including a helical stator and rotor each having a plurality of helical lobes such that drilling fluid flowing through the motor displaceably rotates the rotor within said stator for selectively driving a downhole drilling device, the improvement comprising:

generator means mounted within said casing for generating electrical power to auxiliary devices; and a transmission shaft coupled at a first end to said generator means and at a second end to the rotor of the drilling motor such that the high speed precessional revolution of the rotor center in a first direction about an axis of the stator as said transmission shaft rotates within the stator in a second direction is transmitted to said generator means for generating electrical power.

18. The device as defined in claim 17 wherein said transmission shaft comprises a crankshaft and a power take-off shaft linearly connected to said crankshaft, a first end of said power take-off shaft drivingly connected to said generator means.

19. The device as defined in claim 18 wherein said crankshaft includes a first end connected to said power take-off shaft and axially aligned with said power take-off shaft and a central axis of said stator of said drilling motor, said crankshaft including an offset second end connected to said rotor of said drilling motor, said offset second end of said crankshaft axially aligned with a central axis of said rotor whereby said second end of said crankshaft travels along the center precessional motion of said rotor transmitting high speed rotation to drive said generator means.

* * * * *